US006871437B1

(12) United States Patent
Bartozzi et al.

(10) Patent No.: US 6,871,437 B1
(45) Date of Patent: Mar. 29, 2005

(54) APPARATUS AND METHOD FOR LOCKING FIREARM IN AN OPEN POSITION BY BLOCKING ACTION

(75) Inventors: Joseph H. Bartozzi, Woodbridge, CT (US); Robert A. Talboot, Holland, MA (US); Wayne E. Hopkins, Wallingford, CT (US)

(73) Assignee: O.F. Mossberg & Sons, Inc., North Haven, CT (US)

( * ) Notice: Subject to any disclaimer, the term of this patent is extended or adjusted under 35 U.S.C. 154(b) by 0 days.

(21) Appl. No.: 09/998,814

(22) Filed: Oct. 24, 2001

Related U.S. Application Data

(60) Provisional application No. 60/297,948, filed on Jun. 13, 2001, provisional application No. 60/254,140, filed on Dec. 8, 2000, and provisional application No. 60/242,860, filed on Oct. 24, 2000.

(51) Int. Cl.[7] ..... F41A 17/00

(52) U.S. Cl. ..... 42/70.11; 42/70.01; 89/138

(58) Field of Search ..... 42/70.11, 70.01; 89/138

(56) References Cited

U.S. PATENT DOCUMENTS

| | | | | | |
|---|---|---|---|---|---|
| 2,945,316 | A | | 7/1960 | Mulno | |
| 3,462,869 | A | | 8/1969 | Wallace | |
| 3,673,725 | A | | 7/1972 | Cravener | |
| 3,740,884 | A | * | 6/1973 | Wilhelm | 42/17 |
| 3,882,622 | A | | 5/1975 | Perloto | |
| 4,009,599 | A | | 3/1977 | Patriquin | |
| 4,133,128 | A | * | 1/1979 | Brush | 42/70.01 |
| 4,654,992 | A | * | 4/1987 | Lavergne | 42/70.01 |
| 5,125,178 | A | * | 6/1992 | Justice | 42/70.11 |
| 5,223,649 | A | * | 6/1993 | Claridge | 42/70.01 |
| 5,235,763 | A | | 8/1993 | Nosler et al. | |
| 5,241,769 | A | * | 9/1993 | Von Muller | 42/70.11 |
| 5,419,069 | A | * | 5/1995 | Mumbleau et al. | 42/70.11 |
| 5,465,519 | A | * | 11/1995 | Blanck | 42/70.11 |
| 5,867,928 | A | * | 2/1999 | Plebani | 42/17 |
| 6,405,470 | B1 | * | 6/2002 | Strahan | 42/70.08 |
| 6,510,778 | B1 | * | 1/2003 | Irwin | 89/138 |
| 6,513,273 | B2 | * | 2/2003 | da Silveira | 42/70.08 |

OTHER PUBLICATIONS

Web Site: Saf–T–Trigger™ firearm trigger locking device <http//www.saf–t–hammer.com/safTHammer.htm>.

* cited by examiner

*Primary Examiner*—Michael J. Carone
*Assistant Examiner*—M. Thomson
(74) *Attorney, Agent, or Firm*—Holland & Bonzagni, P.C.; Donald S. Holland, Esq.

(57) ABSTRACT

A method for locking a firearm in an "open" position involves blocking some portion of the firearm's action (internal operational mechanism) with a selectively-extendable locking device accessible from outside the firearm. More specifically, the locking device is positioned at one of a plurality of pre-selected locations on the firearm, and includes a plunger that lies retracted when the device is unlocked, and that extends into the interior of the firearm when locked. The pre-selected location is chosen such that: (i) when locked, the locking device interferes with the firearm's action, preventing it from being closed, and the firearm from being fired; (ii) the locking device can only be locked when the firearm's action is in an open position, with the chamber visually exposed; and (iii) to the extent one is able to operatively disassemble the firearm when the locking device is locked, the locking device cannot be defeated internally.

3 Claims, 14 Drawing Sheets

APPARATUS AND METHOD FOR LOCKING FIREARM IN AN OPEN POSITION BY BLOCKING ACTION

This application claims the benefit of the following three Provisional Applications: Ser. No. 60/242,860, filed Oct. 24, 2000; Ser. No. 60/254,140, filed Dec. 8, 2000; and Ser. No. 60/297,948, filed Jun. 13, 2001.

FIELD OF THE INVENTION

The present invention relates to firearms, and, more particularly, to methods and devices for securing or locking firearms.

BACKGROUND OF THE INVENTION

Because firearms are potentially dangerous when in the wrong hands, many devices have been proposed over the years for preventing firearms from being used by unauthorized persons. Some of these devices, e.g., trigger guard locks, while functional, are fairly cumbersome to use in that they require a user to manipulate various locking parts to secure the firearm. Additionally, when not in use with the firearm, such locking devices must be separately stored, during which time the various loose parts can be easily lost.

Some locking or security devices are integrated into the firearms. These devices typically comprise some sort of electronics system, wherein a user has to key in a code or perform some other action to unlock the firearm for use. These systems are convenient, but are invariably fairly expensive. Additionally, even when the safety systems in such firearms are activated, it is typically the case that ammunition can still be chambered, which raises the possibility of accidental discharge, plus it may be difficult to determine whether or not the firearm's chamber is empty. Additionally, there is a possibility of unauthorized use if the firearm is disassembled and the safety system thwarted.

Accordingly, it is a primary object of the present invention to provide a firearm locking device that is easy to use, inexpensive, integrated into the firearm, and, when the locking device is engaged, that cannot be defeated if the firearm is disassembled and that prevents ammunition from being fired.

Another primary object of the present invention is to provide a method for locking a firearm wherein the firearm cannot be unlocked even if disassembled, that prevents ammunition from being discharged when the firearm is locked, and that easily enables a user to determine that the chamber is empty when the firearm is locked (i.e., the chamber is visually exposed).

SUMMARY OF THE INVENTION

A method for locking a firearm in an "open" position involves blocking some portion of the firearm's action (internal operational mechanism) with a selectively-extendable locking device accessible from outside the firearm. More specifically, the locking device is positioned at one of a plurality of pre-selected locations on the firearm, and includes a plunger portion that lies retracted when the device is unlocked, and that extends into the interior of the firearm when locked. The pre-selected location is chosen such that: (i) when locked, the locking device interferes with the firearm's action, preventing it from being closed, and the firearm from being fired; (ii) the locking device can only be locked when the firearm's action is in an "open" position (i.e., an intermediate operational position wherein the firearm is physically incapable of being fired regardless of the condition of any safety mechanism or if the trigger is pulled); and (iii) to the extent one is able to operatively disassemble the firearm (i.e., take the firearm apart without such damage as would render it useless) when the locking device is locked, the locking device cannot be accessed and/or defeated internally.

For implementing the method summarized above, the locking device can be any one of a number of different integral plunger locks or the like. Preferably, the locking device is low profile and/or unobtrusive, and comprises a lock mechanism or body attached to the firearm and a plunger, as mentioned above, operably coupled to the lock body. The plunger can be selectively extended or retracted using a lock key.

More specifically, one example of a suitable integral locking device comprises: a low profile, cylindrical lock body having a cylindrical through-bore; a cylindrical plunger positioned in the through-bore; and a lock key. The key and the plunger have complementary features that allow the key to engage and turn the plunger. Also, the plunger has a close-ended, helical guide groove on its outer surface, and a stationary pin is connected to and through the lock body, with its end lying within the helical guide groove. To actuate the lock, the key is used to turn the plunger. As the plunger rotates, the helical guide groove tracks along the pin, causing the plunger to extend or retract.

BRIEF DESCRIPTION OF THE DRAWINGS

These and other features, aspects, and advantages of the present invention will become better understood with respect to the following description, appended claims, and accompanying drawings, in which:

DETAILED DESCRIPTION OF THE INVENTION

Turning now to FIGS. 1–5, a preferred embodiment of a method for locking a firearm 20, according to the present invention, will now be given. The method involves positioning an integral blocking or locking device or means 22 (hereinafter referred to as a locking device) at one of a plurality of pre-selected locations on the firearm 20, wherein the pre-selected location is preferably chosen such that: (i) when locked, the locking device 22 interferes with the firearm's action, preventing it from being closed, and the firearm from being fired; (ii) the locking device 22 can only be locked when the firearm's action is in an "open" position (i.e., an intermediate operational position wherein the firearm is physically incapable of being fired regardless of the condition of any safety mechanism or if the trigger is pulled, and wherein the chamber is visually exposed); and (iii) to the extent one is able to operatively disassemble the firearm (i.e., take the firearm apart without such damage as would render it useless) when the locking device is locked, the locking device cannot be accessed and/or defeated internally.

Figure 5:
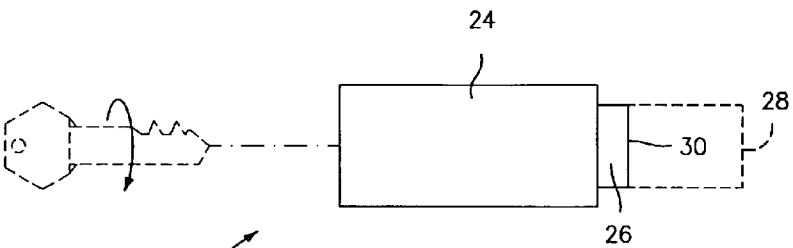
FIG. 5 is a schematic view of a locking device.

Preferably, as shown in FIG. 5, the integral blocking or locking device 22 (blocking means) comprises some sort of lock mechanism or body 24 having a selectively-extendable plunger, rod, or bolt 26 that lies in an extended position 28 when the lock mechanism 24 is locked (via a key, electronic signal, or the like) and a retracted position 30 when the lock mechanism 24 is unlocked. Suitable locking devices are discussed further below. However, as should be appreciated, any number of other locking or blocking devices or means are also suitable for carrying out the method of the present invention, and further explanation herein with respect to particular types of locking devices is exemplary only. Also, by "integral," it is meant that the locking device is part of the firearm, and is not a separate component (or set of components) that is selectively affixed to or removed from the firearm by a user for securing or unsecuring the firearm, respectively.

The method according to the present invention will now be specifically illustrated in regards to a standard pump shotgun. However, the method can be applied to different types and models of firearms, by merely applying the inventive concepts taught herein to the particular type and/or model of firearm on a case-by-case basis, as further discussed herein.

FIGS. 1–4A show a portion of the action 40 (internal operational mechanism) of a typical pump shotgun 20. Auto-loading shotguns, with either gas piston or recoil operation, have the same basic parts and corresponding geometry. Here, the action 40 is shown against the backdrop of a receiver 42. The receiver 42 is a central portion of the firearm's frame with which some of the components of the action cooperate, e.g., are pivotally attached to, or slide along. In the action 40, one or more action bars 44, whether operated automatically or manually, are attached to a bolt slide 46, which in turn determines the position of a bolt 48. An elevator or shell carrier 50 operates either directly or indirectly according to the position of the bolt slide 46 and bolt 48. The elevator (shell carrier) 50 is the mechanism that accepts a round (not shown) from the shotgun's magazine 52 and positions the round so that as the bolt 48 moves forward the round is inserted into the barrel chamber 54 of the shotgun (as should be appreciated, the actual chamber and magazine are not shown in FIGS. 1 and 2; rather their respective element numbers indicate general positioning relative the action).

Figure 1:
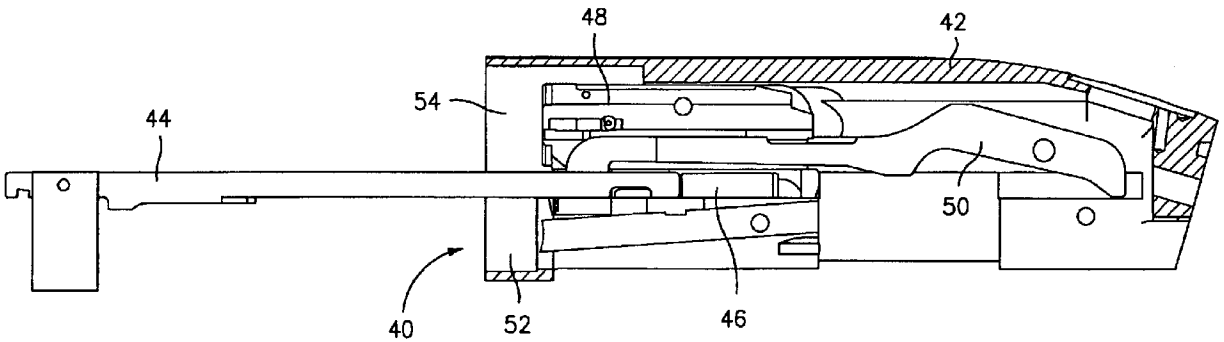
FIG. 1 is a cut-away elevation view of the action of a typical shotgun in a "closed" position.
Figure 2:
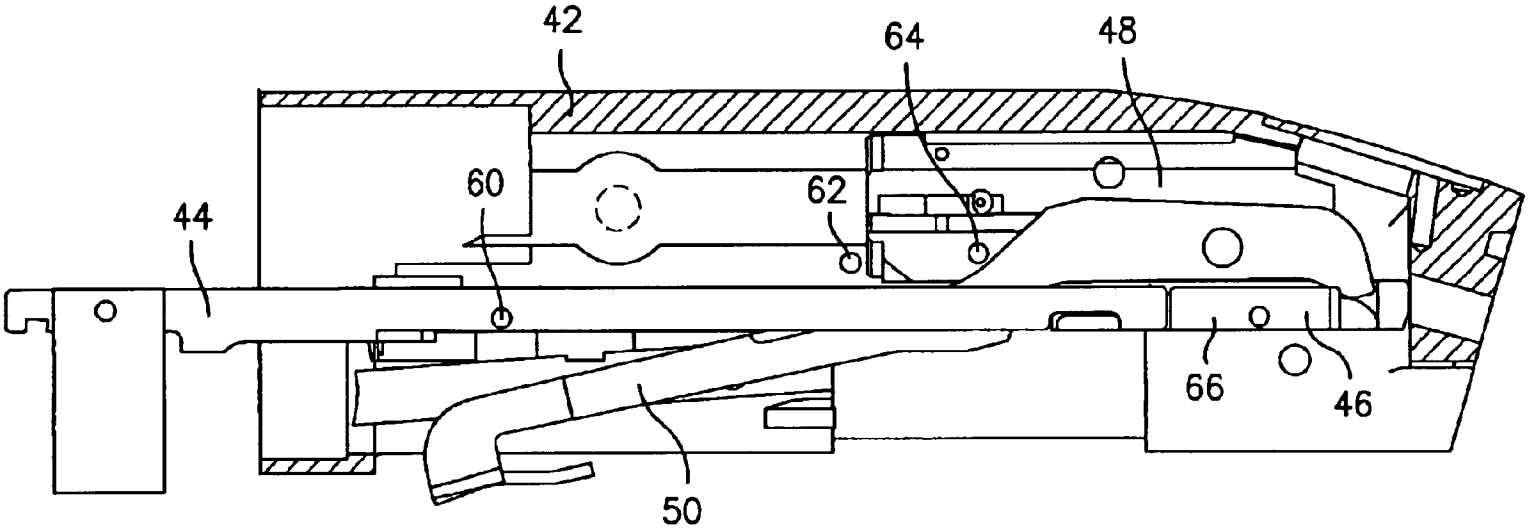
FIG. 2 is a cut-away elevation view of the action shown in FIG. 1 in an "open" position.

FIG. 1 shows the action 40 in a closed position, and FIG. 2 shows the action 40 in an open position. By comparing FIGS. 1 and 2, normal operation of the action 40 can be understood by noting the movement of the various components. For example, to chamber a round, the action bar 44 is moved rearwards from its position in FIG. 1, along with the bolt slide 46. This causes the bolt 48 to also move rearwards, effectively exposing the chamber. At the same time, the elevator 50 pivots downwards to accept a round from the shotgun's magazine. This is the condition shown in FIG. 2. Subsequently, the action bar 44 is moved forwards, causing the elevator or shell carrier 50 (carrying a round) to pivot upwards, and the bolt slide 46 and bolt 48 to also move to forward. The timing/movement of the bolt and elevator are coordinated such that the elevator 50 reaches its "closed" position first, as in FIG. 1, with the round positioned before the chamber, and then the forward-moving bolt 48 inserts the round into the chamber 54.

When the action 40 is in an open position, as shown in FIG. 2, the shotgun 20 cannot be fired. The chamber 54 is empty, and the next live round coming from the magazine 52 (if one is available), is in an intermediate position, e.g., being carried by the elevator 50, and cannot be discharged. Moreover, it is typically the case that the chamber 54 is open to the outside, allowing for easy visual inspection of whether or not the chamber is empty.

For locking the shotgun 20 in an open position, restricting the movement of any of the components of the action 40 effectively disables the firearm. Accordingly, the locking device 22 is attached to the firearm so that when the locking device 22 is locked, the plunger 26 is extended and blocks or restrictively engages some portion of the action 40. When the action 40 is the plunger 26, the shotgun 20 cannot be fired, and it is easy for one to determine that there is no ammunition in the chamber and that the shotgun is inoperable, as mentioned above.

To carry out the method of the present invention, an appropriate location for attaching the locking device 22 must be determined. More specifically, it is typically insufficient to attach the locking device to just any location where the plunger 26 will interfere with the action 40. Instead, the location should be selected such that: (i) when locked, the locking device 22 interferes with the action 40, preventing it from being closed, and the firearm from being fired; (ii) the locking device 22 can only be locked when the action 40 is in an "open" position; and (iii) even if the shotgun 20 is operatively disassembled, the locking device 22 cannot be accessed and/or defeated internally.

Regarding the first factor, the locking device 22 should interfere with some portion of the action 40 when the locking device 22 is locked with its plunger (or rod or bolt) 26 extended. For the shotgun 20, as shown in FIG. 2, the locking device can be positioned at a first position 60 to block or engage the action bar 44, a second position 62 to block or engage the bolt 48, a third position 64 to block or engage the elevator 50, or a fourth position 66 to block the bolt slide 46. Any number of locations are suitable, keeping in mind that the selected component being blocked can be locked or engaged directly (e.g., it can be provided with a hole for receiving the plunger 26), or the path of its movement can be blocked.

Regarding the second factor, the locking device 22 is preferably positioned such that it can only be locked when the action 40 is open. This prevents the shotgun from being locked when a live round is in the chamber 54, as would raise concerns of accidental discharge, or, more likely, conscious discharge if the shotgun 20 is of the type that can be fired even when the action 40 is immobile. Additionally, locking the shotgun 20 when open allows users to easily determine that the chamber 54 is empty. To achieve this goal, the locking device 22 should be positioned at a location where when the action 40 of the shotgun 20 is in a closed position, and a user attempts to lock the locking device 22, the plunger 26 strikes a portion of the action and cannot be fully extended. That way, the locking device 22 can only be locked when the action 40 is open. Suitable locations for a shotgun include the locations 60, 62, 64, and 66 shown in FIG. 2. Additionally, suitable locations for other types of firearms (or additional suitable locations for shotguns) may be found by examining the internal structure of the firearm's action when closed (either the firearm itself or its schematics can be examined) to identify and eliminate all the locations on the firearm where the plunger 26 could be fully extended when the action 40 is closed.

Finally, it is preferred that the locking device 22 be positioned such that it cannot be accessed and/or defeated internally, even by operative disassembly of the firearm, when the action is locked open. This prevents someone from simply taking apart certain portions of the firearm, removing or disabling the locking device 22, and reassembling the firearm for use. In the shotgun 20, many suitable locations are available proximate the receiver 42, such as the aforementioned locations 60, 62, 64, and 66. At these locations, when the action 40 is locked open, it is impossible to disassemble and access the interior region of the receiver 42 without the use of excessive force (of the kind that would probably render the shotgun nonfunctional). More specifically, in the case of the shotgun 20, it is possible to remove a trigger housing portion of the shotgun (not shown) when the locking device is actuated. However, even if the trigger housing is removed, the locking device is located behind other portions of the firearm, and cannot be accessed internally. Moreover, the locking device prevents further disassembly beyond the trigger housing. In the case of other types of firearms, similar locations can be determined empirically. Additionally, it should be appreciated that the design of the locking device 22 can be chosen such that it not be easily thwarted even if accessed from inside the firearm.

Figure 3:
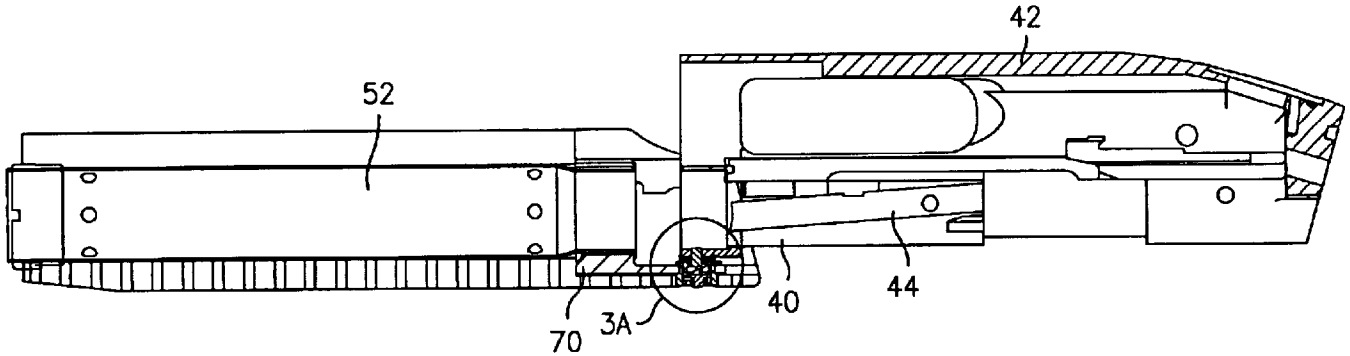
FIGS. 3 & 3A are cut-away views of a fore portion of a typical shotgun action showing an additional location for affixing a locking device, according to the present invention.
Figure 3A:
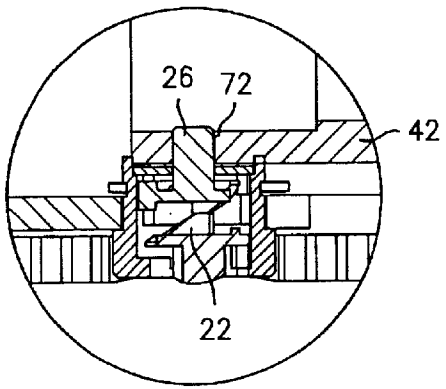
Figure 4:
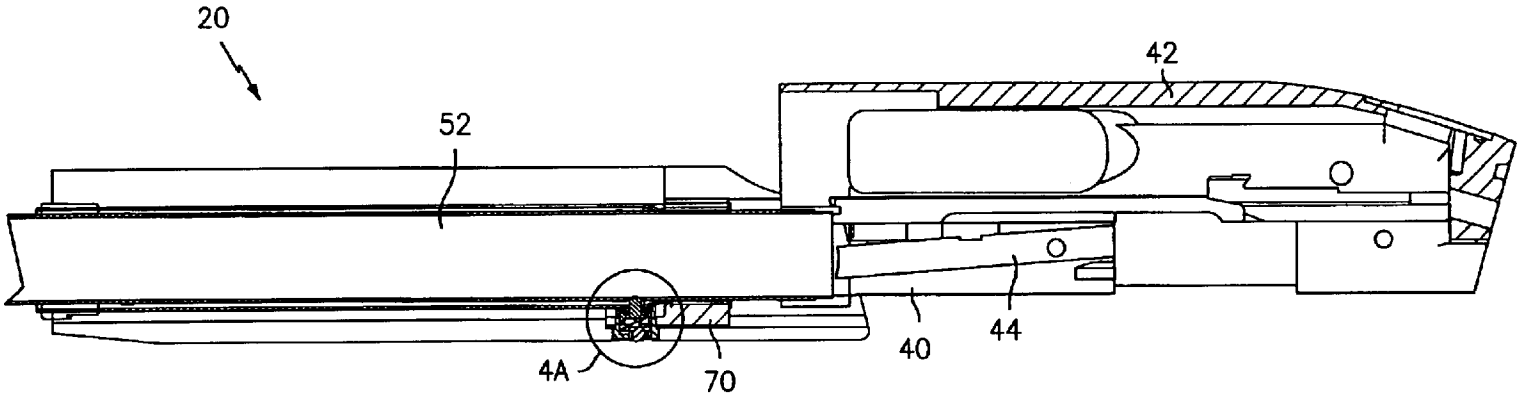
FIGS. 4 & 4A are cut-away views of a fore portion of a shotgun action showing another additional location for affixing a locking device.
Figure 4A:
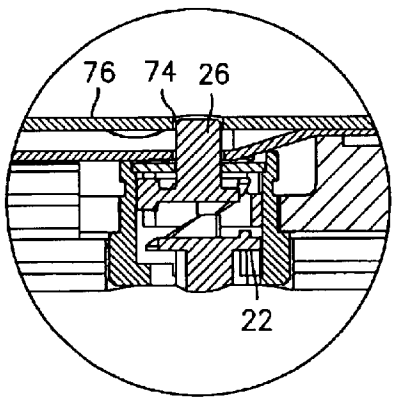

FIGS. 3–4A show additional locations for affixing the locking device 22 to a shotgun 20. In FIGS. 3 and 3A, the locking device 22 is affixed to a modified action slide tube adapter portion 70 of the shotgun 20. The pin portion 26 of the locking device 22 cooperates with a receiver lock pin hole 72 provided in the receiver 42. In accordance with the teachings above, the receiver lock pin hole 72 is provided so that the pin 26 can preferably only be extended when the action is in an open position, e.g., as shown in FIG. 2.

Additionally, in FIGS. 4 and 4A, the locking device 22 is again affixed to the modified action slide tube adapter 70. Here, however, the pin 26 cooperates with a magazine tube pin hole 74 provided in the shotgun's magazine tube 76. Again, the magazine tube pin hole 74 and locking device 22 are positioned so that the pin 26 can preferably only be extended when the action is in an open position. Other, similar locations towards the fore of the shotgun are also possible.

As should be appreciated, the method according to the present invention involves determining three sets of locations on the shotgun 20 or other firearm: (i) those locations where a locking device will interfere with the firearm's action; (ii) those locations where a locking device can only be locked when the action is open; and (iii) those locations where the locking device cannot be accessed and/or defeated internally, even to the extent one is able to operatively disassemble the firearm when the locking device is locked. The union of these three sets of locations provides a subset of locations that are suitable for placing a locking device according to the present invention.

Once a suitable location has been chosen, the locking device 22 can be affixed to the firearm in a conventional manner, depending on the design of the particular locking device that is being used, and as further discussed below. Once attached, the plunger 26 will be retracted when the locking device 22 is unlocked, with the shotgun 20 or other firearm being operable in a normal manner. When locked, with the action of the shotgun in an open position, the plunger 26 will extend into the interior of the shotgun 20, blocking some portion of the action 40 (e.g., blocking the rotation of the elevator 50 as at position 64), locking the shotgun open, and rendering the shotgun 20 incapable of firing ammunition. Also, when the action 40 of the shotgun 20 is closed, the locking device 22 cannot be locked because the plunger 26 cannot be extended (it hits the elevator or some other portion of the action). Thus, to engage the locking device 22, the shotgun's action must be open. Correspondingly, with the action open and the locking mechanism engaged, the action cannot be closed. This prevents the shotgun from being fired. Also, because the action is open, it is very apparent to observers that the shotgun is in a disarmed and unusable state.

Figures 6A, 6B:
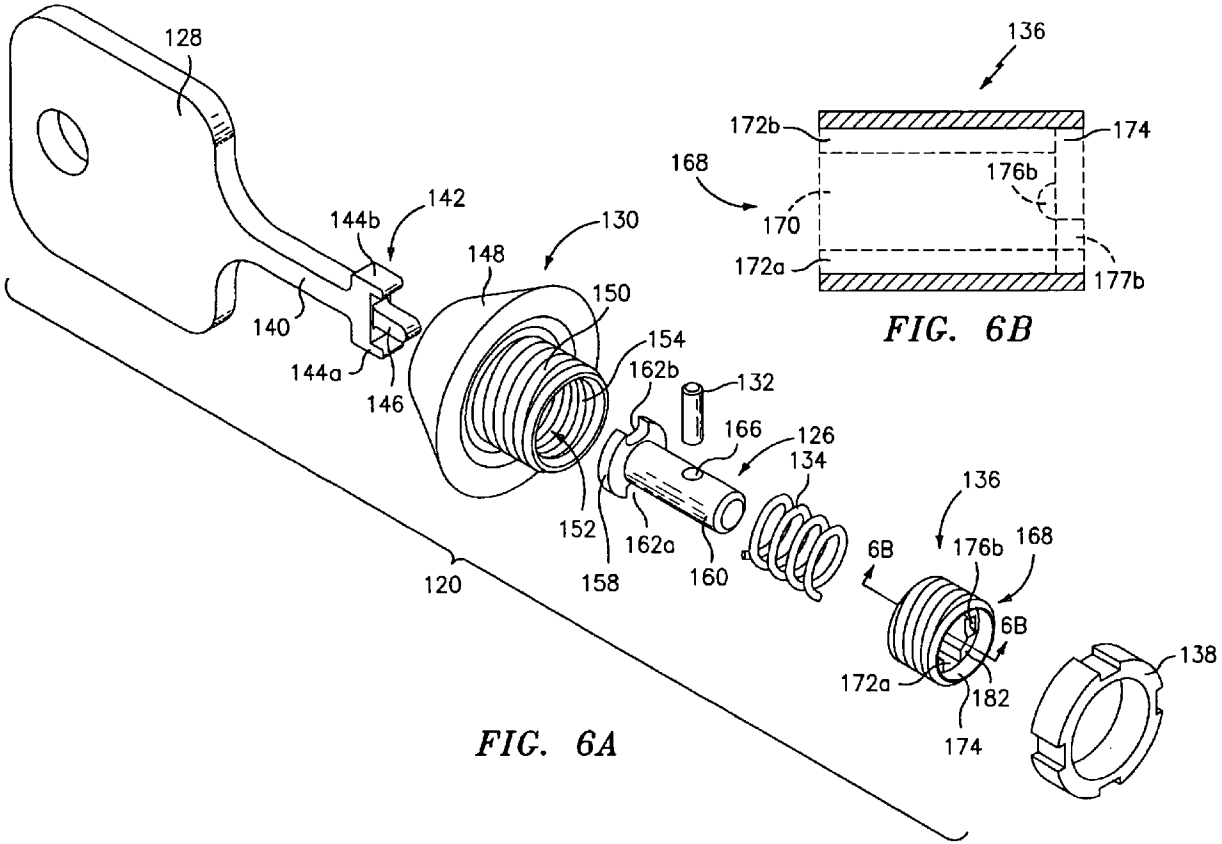
FIG. 6A is an exploded perspective view of a first embodiment of an integral locking device for firearms.
FIG. 6B is a cross-sectional elevation view of an end cap portion of the locking device.
Figure 6C:
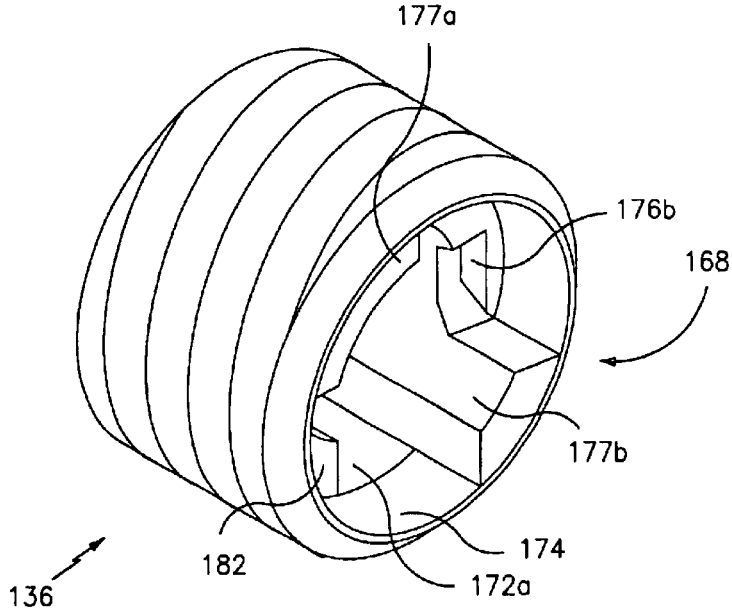
FIG. 6C is a perspective view of a first embodiment of the end cap.
Figure 6D:
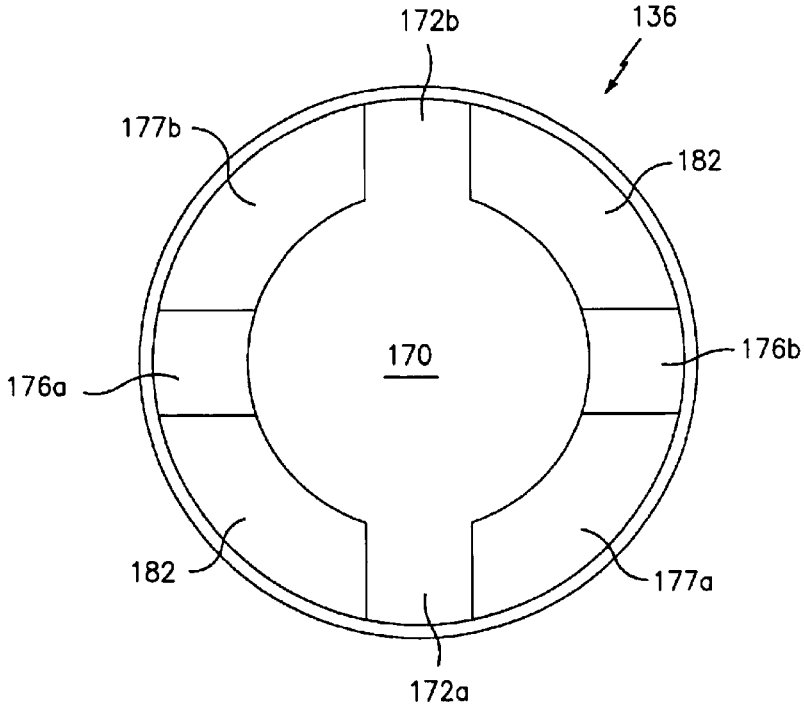
FIG. 6D is a plan view of the first embodiment of the end cap.
Figure 7:
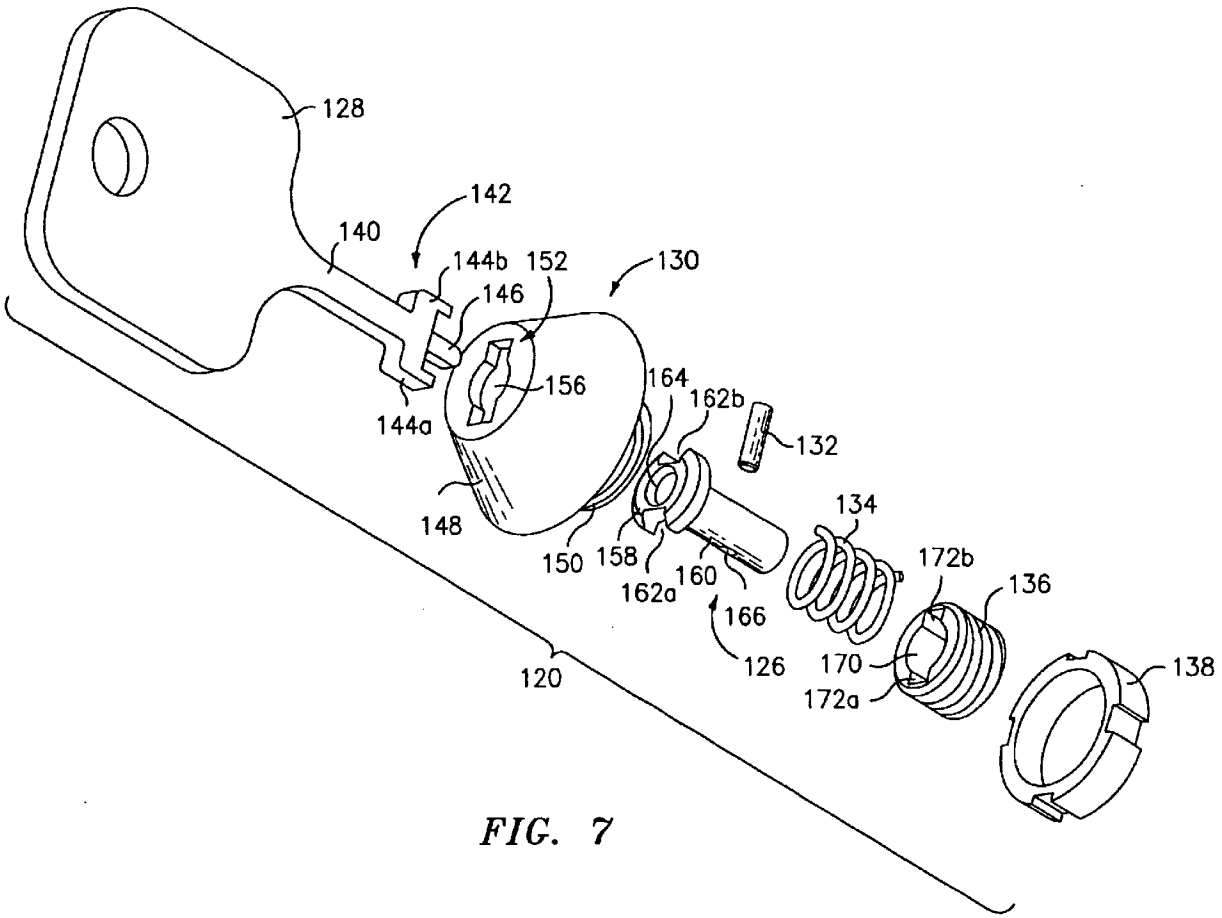
FIG. 7 is a second exploded perspective view of the locking device.
Figure 8:
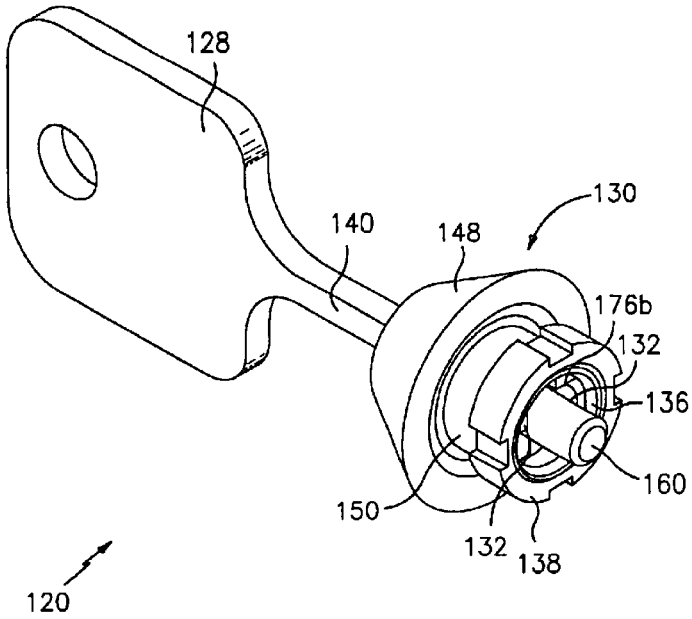
FIG. 8 is a perspective view of the assembled locking device.
Figure 9:
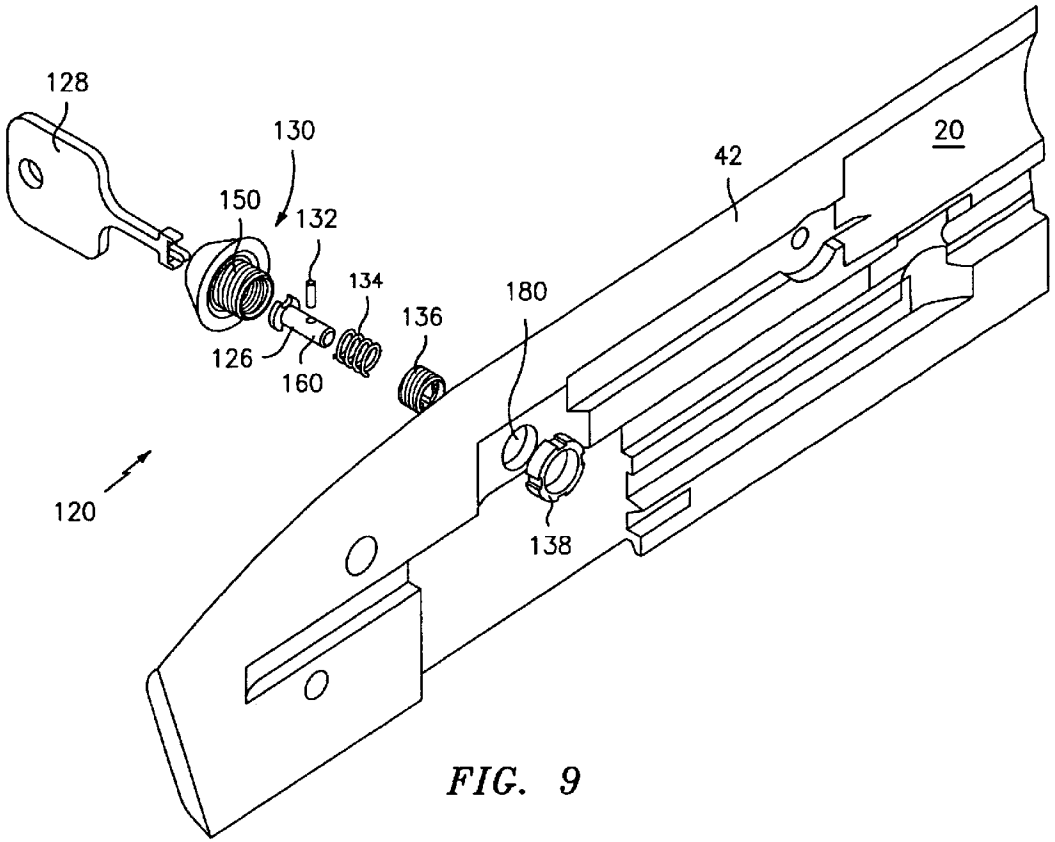
FIG. 9 is an exploded perspective view of the locking device with respect to its positioning on a firearm.
Figure 10B:
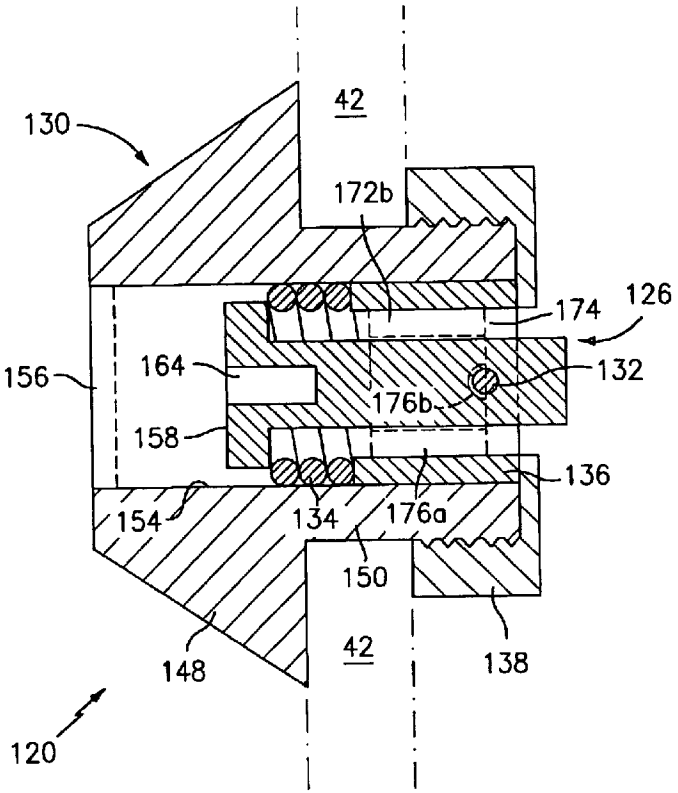
FIG. 10B is a cross-sectional elevation view of the locking device in a locked position.

FIGS. 6A–10B show a first integral blocking or locking device 120 (blocking means) suitable for use as the locking device 22, for carrying out the method described above, or for otherwise locking firearms. The locking device 120 is attached to and extends through the side of a firearm, e.g., as to the receiver 42 of a shotgun 20. In an unlocked position (see FIG. 10A), a lock plunger portion 126 of the locking device 120 is retracted, with the shotgun 20 being operable in a normal manner. When engaged, as shown in FIGS. 8 and 10B, with the action of the shotgun in an open position, the lock plunger 126 extends into the interior of the shotgun 20, blocking or engaging the shotgun's shell carrier or some other portion of the action, locking the shotgun open, and rendering the shotgun 20 incapable of firing ammunition.

The locking device 120 comprises: a lock key 128; a lock body 130; the lock plunger 126; a cross pin 132; a plunger spring 134; a lock end cap 136; and a lock body nut 138. The lock key 128, as its name implies, is key-like, and has a narrow neck portion 140, at the end of which is affixed a U-shaped prong 142. The prong 142 comprises two opposed, offset, forward-extending wings 144*a*, 144*b*. An extension tongue 146, smaller in cross-section than the neck 140 but co-axial therewith, extends away from the center of the prong 142 and past the ends of the wings 144*a*, 144*b*.

Figure 10A:
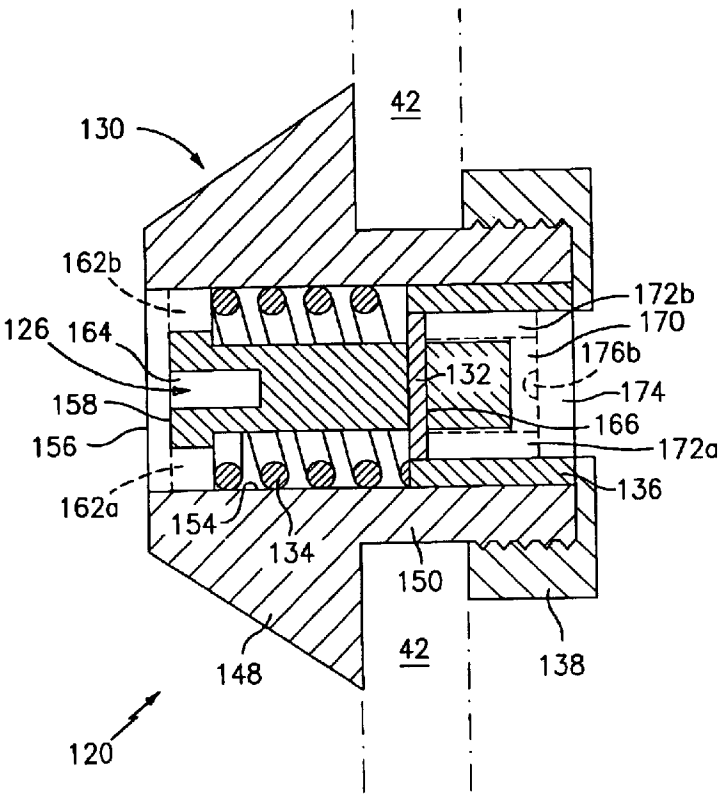
FIG. 10A is a cross-sectional elevation view of the locking device in an unlocked position.

The lock body 130 is generally bolt-like, and has a flared head 148 (defining the rear of the locking device) integral with a cylindrical extension 150 (defining the fore of the locking device), the outer surface of which is threaded. The head 148 can be frustoconical or any other shape. A keyway 152 extends longitudinally through the lock body 130. The keyway 152 has two sections: as shown in FIGS. 6A, 10A and 10B, a cylindrical bore 154 that extends all the way through the cylindrical extension 150 and most of the way through the head 148 of the lock body 130; and, as shown in FIG. 7, a shaped entry slot 156 that extends from the front of the head 148 through to the cylindrical bore 154. The entry slot 156 is rectangular in overall shape, with a rounded or bulged mid-portion. As should be appreciated, the key 128 is dimensioned to pass through the entry slot 156, such that once the leading prong portion 142 of the key 128 is past the entry slot 156, the key 128 can be rotated. More specifically, the cylindrical bore 154 is wide enough to accommodate the prong 142 rotating therein, and the bulged mid-portion of the entry slot 156 is wide enough to accommodate the neck 140 of the key 128 rotating therein.

The lock plunger 126 comprises a slotted head 158 attached to a plunger shaft 160. The slotted head 158 is round, and is dimensioned to fit within the cylindrical bore 154 (e.g., the diameter of the slotted head 158 is a bit less than the diameter of the cylindrical bore 154). The slotted head 158 has two opposed notches 162*a*, 162*b*, and a cylindrical, longitudinal bore 164 which extends through the slotted head 158 and part-ways through the shaft 160. The opposed notches 162*a*, 162*b* are dimensioned to accommodate the U-shaped prong 142 of the lock key 128, and the plunger bore 164 is dimensioned to accommodate the tongue 146 of the lock key 128. More specifically, if the prong portion 142 of the key 128 is properly aligned and brought to bear against the slotted head 158, the tongue 146 extends into the plunger bore 164 and the two opposed, offset, forward-extending wings 144*a*, 144*b* respectively rest in the opposed notches 162*a*, 162*b*. The plunger 126 also has a transverse bore 166 extending through the shaft 160. The transverse bore 166 is dimensioned to accept the cross pin 132.

The lock end cap 136 is generally cylindrical, and is dimensioned to fit within the cylindrical bore 154 of the lock body 130. As best seen in FIGS. 6B–6D, the end cap 136 has a longitudinal space 168 extending there through, which comprises: a cylindrical central portion 170; two opposed slots 172*a*, 172*b* running along either side of the central portion 170; an annular end space 174; and two opposed, rounded recesses 176*a*, 176*b* extending back from the annular space 174. The plunger shaft 160 is dimensioned to fit within the cylindrical central portion 170, while the cross pin 132 is dimensioned to laterally pass through and track along the opposed slots 172*a*, 172*b*. The annular end space 174 is dimensioned to accommodate the cross pin 132, both in terms of diameter (equal to or slightly greater than the length of the cross pin 132) and length (equal to or slightly longer than the width of the cross pin 132). The rounded recesses 176*a*, 176*b*, set back from the rear edge of the annular space 174, are offset approximately 90° from the opposed slots 172*a*, 172*b* (note that the degree of offset is not important). The cross pin 132 is dimensioned to nestle in and lie between the rounded recesses 176*a*, 176*b* in a lateral manner. More specifically, the distance from the far side of one rounded recess to the other is approximately equal to the length of the cross pin 132, and the radii of curvature of the rounded recesses 176*a*, 176*b* is approximately equal to the radius of curvature of the cross pin 132.

The end cap 136 also has two opposed stops 177*a*, 177*b* (for clarity of illustration, not shown in FIG. 6A) partitioning the annular space 174 and aligning with respective edges of the recesses 176*a*, 176*b*. The stops 177*a*, 177*b* are extensions of the portion of the end cap that defines the cylindrical central portion 170 of the longitudinal space 168. One stop 177*a* extends between one slot 172*a* and one recess 176*b*, while the other stop 177*b* extends between the other slot 172*b* and the other recess 176*a*.

The lock body nut 138 has an inner threaded surface, and is complementary in size to the cylindrical extension 150 of the lock body 130.

To assemble the locking device 120, as shown in FIGS. 8–10B, the spring 134 is placed over the plunger shaft 160 and against the plunger head 158. Then, the cross pin 132 is inserted through the transverse bore 166, with the spring 134 lying between the cross pin 132 and the head 158 of the plunger shaft 160. The pin 132 should be positioned such that its ends extend equally past the shaft 160. Subsequently, the end cap 136 is placed over the plunger shaft 160, with the plunger shaft 160 extending part-ways into the central portion 170 of the longitudinal through-space 168 and the cross pin 132 extending between the opposed slots 172*a*, 172*b*. Here, the spring 134 rests between the head 158 of the lock plunger 126 and the rear end surface of the lock end cap 136.

To keep the end cap 136 in place in the cylindrical bore 154 and the assembly together, the outer surface of the end cap 136 is preferably threaded to engage threading provided in the cylindrical bore 154 (e.g., for assembly, the end cap is screwed into the bore 154). Alternatively, as shown in FIGS. 10A and 10B, the lock body nut 138 may have an inwardly directed retaining flange.

The end cap assembly is screwed into or placed in the cylindrical bore 154 of the lock body 130. Then, as best shown in FIG. 9, the lock body 130 is brought to bear against an outer surface of the shotgun receiver 42 at a predetermined location (e.g., a point where the plunger, when extended into the interior of the shotgun, interferes with to one of the shotgun's operational mechanisms), with the cylindrical extension 150 of the lock body 130 extending through a hole 180 provided in the receiver 42. Subsequently, the lock body nut 138 is screwed onto the outer threaded surface of the cylindrical extension 150 and against the inner surface of the receiver 42, securing the locking device 120 to the firearm (see FIGS. 9–10B).

To lock the locking device 120, the key 128 is inserted into the keyway 152 through the entry slot 156 until the prong 142 engages the plunger head 158 (e.g., with the tongue 146 extending into the plunger bore 164 and the two opposed wings 144*a*, 144*b* of the prong 142 respectively resting in the opposed notches 62*a*, 162*b* of the head 158). The key 128 and the plunger 126 are pushed forwards against the pressure of the spring 134. The cross pin 132, constrained laterally between the opposed slots 172*a*, 172*b*, tracks along. The key 128 and plunger 126 are pushed forwards until the cross pin 132 clears the ends of the opposed slots 172*a*, 172*b* and lies within the annular end space 174. By this time, the prong 142 is well clear of the entry slot 156, with the neck 140 of the key 128 being free to rotate in the rounded, bulging mid-portion of the entry slot 156. Subsequently, the key 128 is rotated, with the prong 142 engaging the plunger head 158 and causing the plunger 126 and cross pin 132 to rotate (because of the stops 177*a*, 177*b*, the pin 132 can only be rotated in one direction). The cross pin 132 is rotated 90° until it hits the stops 177*a*, 177*b*, at which point it is aligned with the rounded recesses 176*a*, 176*b*. Reducing forward pressure on the key 28 allows the spring 134 to bring the pin 132 into nesting, lateral engagement with the rounded recesses 176*a*, 176*b*.

As should be appreciated, the spring 134 pushes against the plunger head 158, keeping the cross pin 132 in place in the recesses 176*a*, 176*b*. The plunger 126 remains extended beyond the lock body nut 138 into the interior of the shotgun 20 (see FIG. 10B), where it blocks the rotation of the shotgun's shell carrier and thereby prevents the action from being closed and the shotgun from being fired. The key 128 is pulled rearwards through the cylindrical bore 154, rotated until the prong 142 aligns with the entry slot 156, and extracted.

As mentioned above, when the locking device 120 is used in a shotgun 20, it is positioned so as to interfere with the shotgun's elevator or shell carrier (or some other portion of the shotgun's action) when engaged. When the action of the shotgun is closed, the locking device cannot be engaged because the plunger 126 cannot be extended (it hits the shell carrier or some other portion of the action). Thus, to engage the locking device 120, the shotgun's action must be open. Correspondingly, with the action open and the locking device engaged, the action cannot be closed. This prevents the shotgun from being fired. Also, because the action is open, it is very apparent to observers that the shotgun is in a disarmed and unusable state. Moreover, because the action is locked open, it is impossible to disassemble the shotgun, so as to access and thwart the locking device, without the use of excessive force (of the kind that would probably render the shotgun nonfunctional).

To unlock the locking device 120, the key 128 is inserted into the keyway 152 through the entry slot 516 and cylindrical bore 154 until the prong 142 contacts the plunger head 158. Then, the key 128 is rotated until the two opposed wings 144*a*, 144*b* of the prong 142 respectively engage the opposed plunger head notches 162*a*, 162*b*. The key 128 and plunger 126 are pushed forwards, against the pressure of the spring 134, until the cross pin 132 is clear of the rounded recesses 176*a*, 176*b* and lies within the annular end space 174. The key 128, plunger 126, and cross pin 132 are counter-rotated 90° until the pin 132 hits the stops 177*a*, 177*b*, at which point the pin 132 is aligned with the opposed clearance slots 172*a*, 172*b*. With the cross pin 132 being free to move rearwards though the lock end cap 136, the spring 134 causes the plunger 126 to move rearwards, at which time the plunger 126 no longer blocks the shotgun's shell carrier. The key 128 is subsequently removed from the lock body 130, and the shotgun can be used in a conventional manner (the action can be closed and the shotgun fired).

The end cap 136 does not have to be provided with the stops 177*a*, 177*b*, as shown in FIG. 6A. If no stops are provided, the pin 132 can be rotated in either direction through the annular space 174. Typically, to align the pin 132 with the recesses 176*a*, 176*b*, the key 128 will be pushed fully forwards against the action of the spring 134 only until the pin 132 is clear of the opposed slots 172*a*, 172*b*. At that time, forward pressure on the key 128 can be slightly reduced, allowing the spring 134 to push the plunger 126 rearwards until the pin 132 comes to bear against a lip 182 defined by the fore end of the cylindrical central portion 170 of the end cap through-space 168. Further rotation of the key 128 causes the pin 132 to slide along the lip 182 until it "falls" into the rounded recesses 176*a*, 176*b*.

Figure 11C:
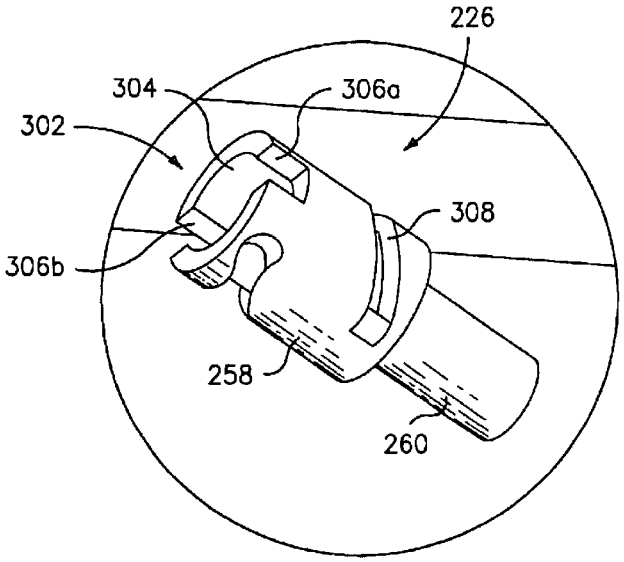
FIG. 11C is an enlarged perspective view of a guided lock plunger portion of the second embodiment of the locking device, according to the present invention.
Figure 11A:
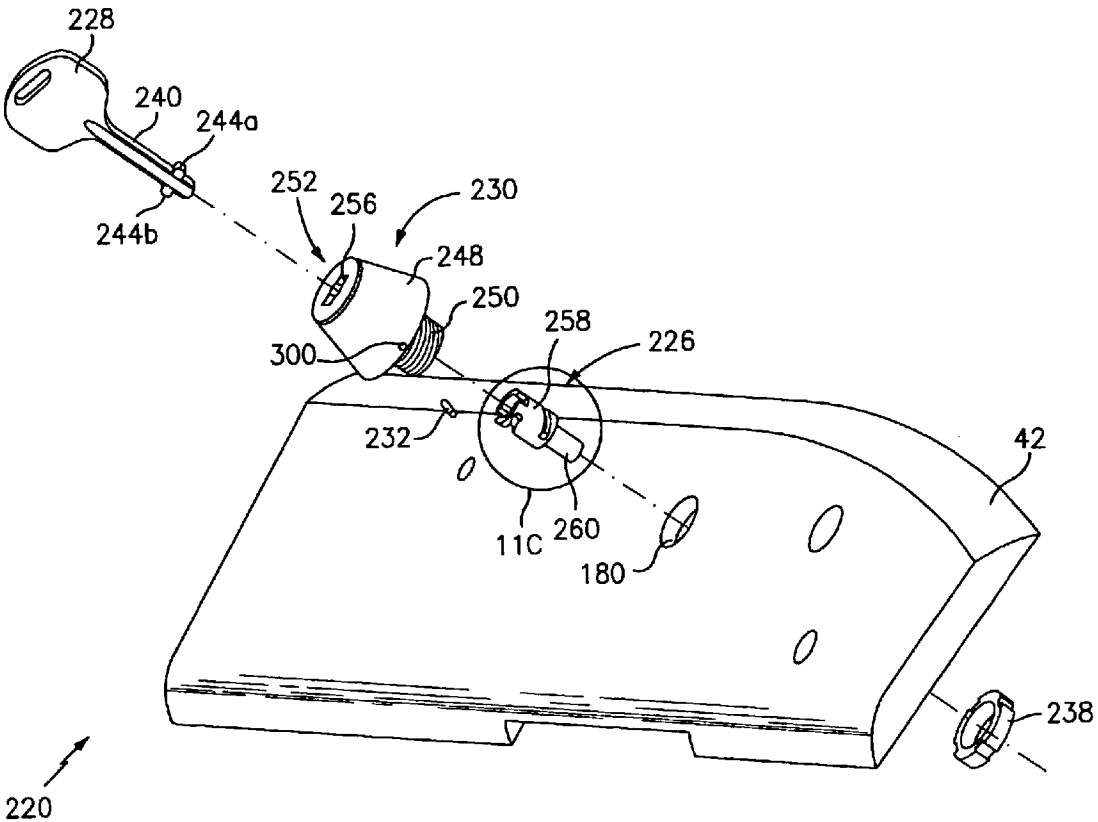
FIG. 11A is an exploded perspective view of a second embodiment of the integral locking device for firearms.
Figure 11B:
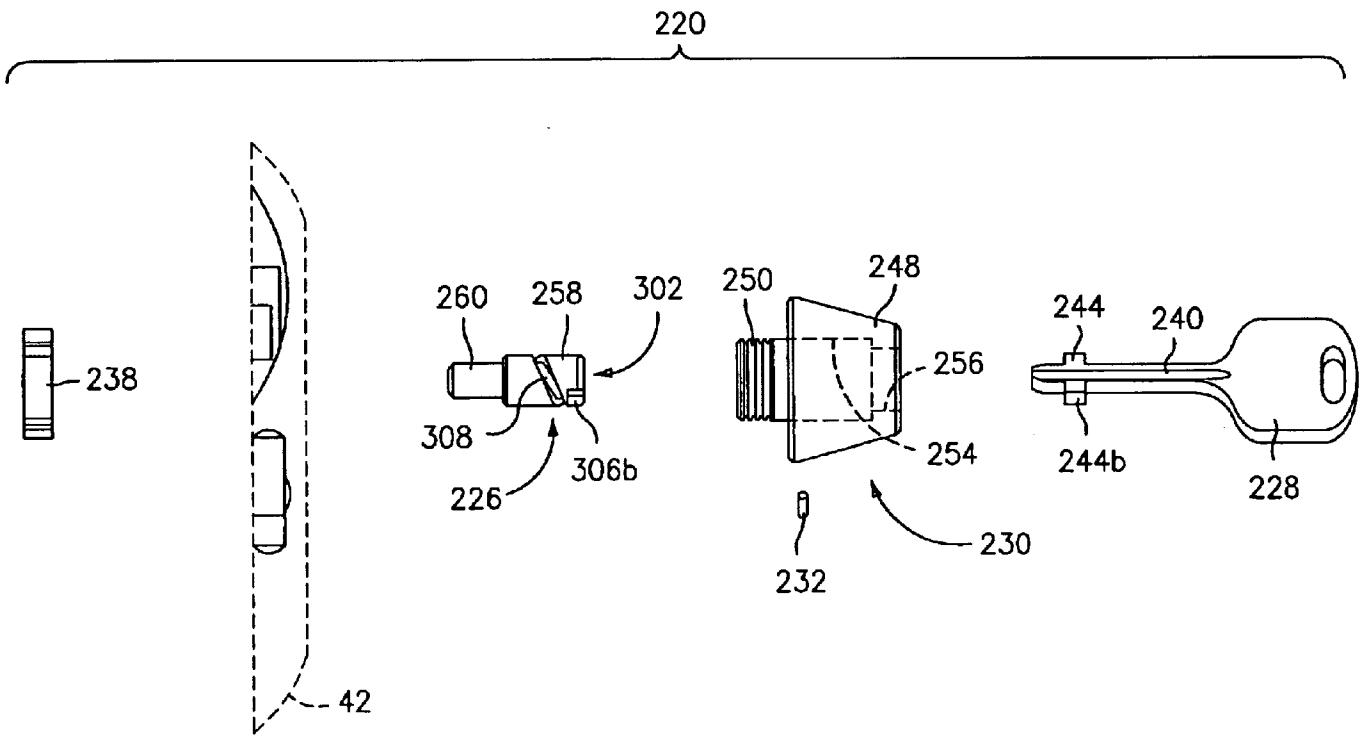
FIG. 11B is an exploded plan view of the second embodiment of the locking device.
Figure 12:
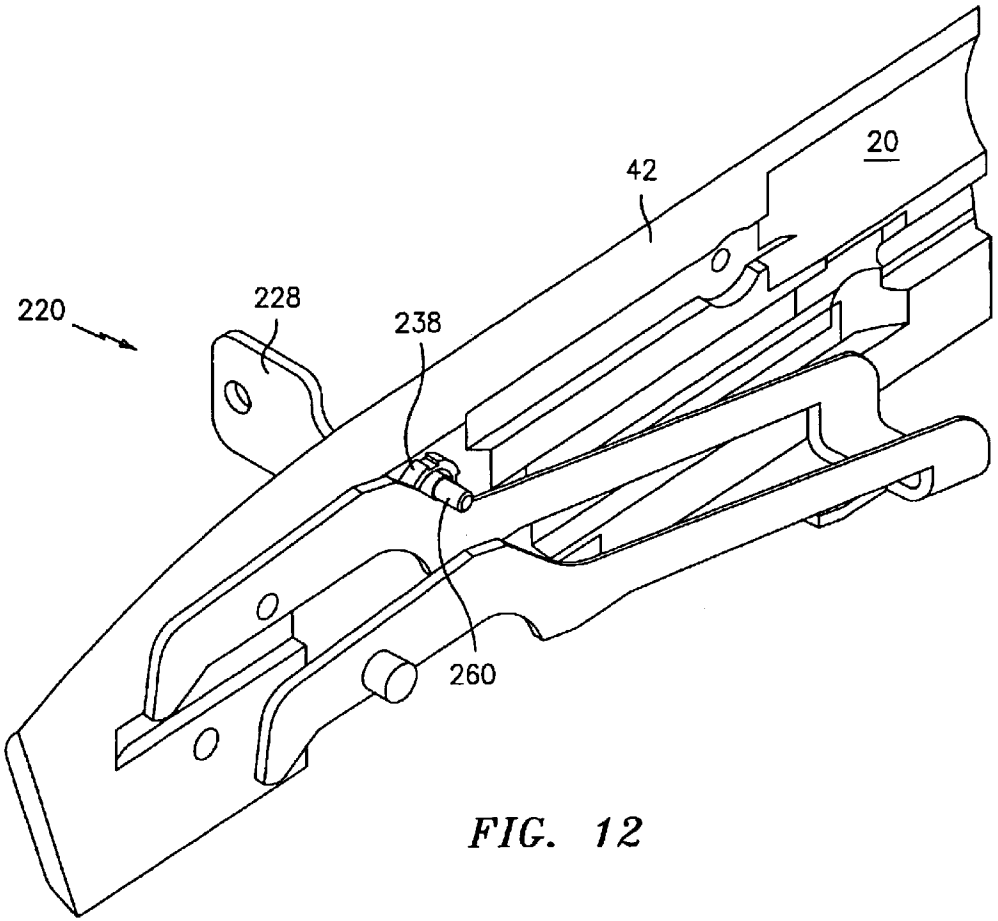
FIG. 12 is a perspective view of the second embodiment in use with a firearm.

Turning now to FIGS. 11–12, a second integral blocking or locking device 220 (blocking means) for firearms, according to the present invention, and suitable for use as the locking device 22, will now be given. Where applicable, similar elements have been given the same reference numerals as above, but offset by 100 (e.g., the key 128 of the first locking device 120 vs. a key 228 of the second locking device 220).

As in the first embodiment, the second integral locking device 220 is attached to and extends through the side of a firearm, e.g., as to the receiver 42 of the shotgun 20. In an unlocked position (not shown), a lock plunger portion 226 of the locking device 220 is retracted, with the shotgun or other firearm 20 being operable in a normal manner. In a locked position, as shown in FIG. 12, with the shotgun's action open, the lock plunger 226 extends into the interior of the shotgun 20, blocking the movement of the shotgun's shell carrier (or some other portion of the action), locking the shotgun open, and rendering the shotgun 20 incapable of firing ammunition.

The locking device 220 comprises: a lock key 228; a lock body 230; the lock plunger 226; a guide pin 232; and a lock body nut 238. The lock key 228 has a narrow neck portion 240, towards the end of which are affixed two opposed, laterally extending teeth 244*a*, 244*b*.

The lock body 230 is generally bolt-like, and has a flared, frustoconical (or other shape) head 248 integral with a cylindrical extension 250, the outer surface of which is threaded. A keyway 252 extends longitudinally through the lock body 230. The keyway 252 has two sections: as shown in FIG. 11B, a cylindrical bore 254 that extends all the way through the cylindrical extension 250 and most of the way through the head 248 of the lock body 230; and, as shown in FIG. 11A, a shaped entry slot 256 that extends from the front of the head 248 through to the cylindrical bore 254. The entry slot 256 is rectangular in overall shape, with a rounded or bulged mid-portion. As should be appreciated, the key 228 is dimensioned to fit in the entry slot 256, such that once the teeth 244*a*, 244*b* are past the entry slot 256, the key 228 can be rotated. More specifically, the cylindrical bore 254 is wide enough to accommodate the teeth 244*a*, 244*b* rotating therein, and the bulged mid-portion of the entry slot 256 is wide enough to accommodate the neck 240 of the key 228 rotating therein. The lock body 230 further comprises a guide pin hole 300 (see FIG. 11A) extending from the outer surface of the head 248 radially through to the cylindrical bore 254. The guide pin hole 300 is sized to accommodate the guide pin 232 via a tight friction fit.

The lock plunger 226 comprises a cylindrical guide head 258 integral and coaxial with a plunger shaft 260. The guide head 258 fits within the cylindrical bore 254 of the lock body 232 (e.g., the diameter of the guide head 258 is just slightly less than the diameter of the cylindrical bore 254). As best seen in FIG. 11C, the rear end of the guide head 258 is provided with a transverse key engagement slot 302. The slot 302 comprises a rounded central bore 304 extending part ways into the guide head 258, and two opposed notches 306*a*, 306*b* extending from the central bore 204 through the sides of the guide head 258. The key 228 is dimensioned to fit in the engagement slot 302, with the end of the neck 240 extending into the central bore 304 and the teeth 244*a*, 244*b* respectively lying within the opposed notches 306*a*, 306*b*.

The guide head 258 is also provided with a close-ended, flat-bottomed, vertically-sided, helical guide groove which starts near the fore end of the guide head 258, curves around the guide head 258, and terminates near the rear end of the guide head 258. The end of the pin 232 is dimensioned to fit in the helical guide groove 308.

To assemble the locking device 220, the guide head portion 258 of the plunger 226 is inserted into the cylindrical bore 254 of the lock body 232. The guide head 258 is rotated and/or slid in or out until some portion of the helical guide groove 308 is aligned with the guide pin hole 300. The guide pin 232 is inserted into the guide pin hole 300 until its end lies within the helical guide groove 308 (e.g., the pin 232 is pushed through the hole 300 until it hits the bottom of the guide groove 308). The pin 232 keeps the plunger 226 in place in the lock body 230, and facilitates the extension and retraction of the plunger 226, as further discussed below. The pin 232 may be kept in place via a friction fit with the guide pin hole 300, or it may be adhered in place via a standard adhesive. Typically, the pin 232 will lie completely within the hole 300, so that it cannot be easily removed.

As should be appreciated, to facilitate easy assembly of the locking device 220, the various parts can be dimensioned such that when the plunger 226 is inserted fully into the lock body 230 and engagement slot 302 is aligned with the entry slot 256, the end of the pin 232, when inserted through the hole 300, lies within the fore end of the groove 308 (the end closest to the plunger shaft 260).

To finish assembling the locking device 220, the lock body 230 is brought to bear against the receiver 42 of the shotgun 20 at a predetermined position, with the cylindrical extension 250 passing through the hole 180 provided in the receiver 42. Then, the nut 238 is screwed down over the threaded cylindrical extension and against the inner surface of the receiver 42, securing the locking device 220 to the firearm 20.

To lock the locking device 220, the action must be open, as discussed above (because the plunger would hit the shell carrier or some other portion of the action if the action was closed). The key 228 is inserted into the keyway 252 through the entry slot 256 until the key 228 engages the engagement slot 302 on the plunger guide head 258 (e.g., with the end of the neck 240 extending into the bore 304 and the two teeth 244*a*, 244*b* respectively resting in the opposed notches 306*a*, 306*b*). The key 228 is rotated clockwise, causing the plunger 226 to rotate clockwise. As the plunger 226 rotates, it is forced forwards via the helical groove 308 tracking along the stationary pin 232. At the point where the pin 232 meets the rear end of the groove 308 (the end closest to the key engagement slot 302), the plunger is fully extended, as shown in FIG. 12, and the key 228 can no longer be rotated clockwise. At this point, the plunger 226 extends beyond the lock body nut 238 and into the interior of the shotgun 20, where it blocks the rotation of the shotgun's shell carrier and thereby prevents the action from closing and the shotgun from being fired. The key 228 is pulled rearwards through the cylindrical bore 254, rotated until the teeth 244*a*, 244*b* align with the entry slot 256, and extracted.

To prevent the plunger 226 from moving rearwards of its own accord (this is unlikely to occur because of the helical shape of the groove 308, but it could happen in theory if the firearm 20 was strongly twisted numerous times), the pin 232 may be loosely friction fit in the groove 308, e.g., such that the groove 308 can track along the pin 232 when the plunger 226 is rotated by the key 228, but not via inertial movement or the like. Also, the lock body and plunger may be provided with complementary features (e.g., a ring and annular detent) to prevent the plunger from moving rearwards.

To unlock the locking device 220, the key 228 is inserted into the keyway 252 through the entry slot 256 and cylindrical bore 254 until the teeth 244*a*, 244*b* contact the guide head 258 of the plunger 226. Then, the key 228 is rotated until the two opposed teeth 244*a*, 244*b* respectively engage the opposed notches 306*a*, 306*b* of the plunger guide head 258. Then, the key 228 is rotated counter-clockwise, causing the plunger 226 to likewise rotate counterclockwise. As the plunger 226 counter-rotates, it is forced rearwards via the helical groove 308 tracking along the stationary pin 232. At the point where the pin 232 meets the fore end of the groove 308 (the end closest to the plunger shaft 260), the plunger is fully retracted (this position is not shown in the drawings), and the key 228 can no longer be rotated counter-clockwise. The key 228 is subsequently removed from the lock body 230, and the shotgun can be used in a conventional manner (the action can be closed and the shotgun fired).

Figure 13:
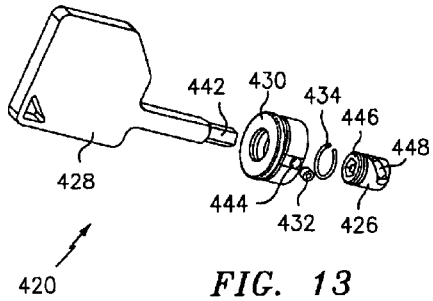
FIG. 13 is an exploded perspective view of a third embodiment of an integral locking device for firearms.
Figure 14B:
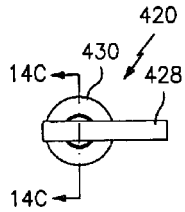
FIGS. 14A–14C are various views (perspective, end plan, and cross-sectional, respectively), of the third embodiment of the integral locking device, in an unlocked or retracted position.
Figure 14A:
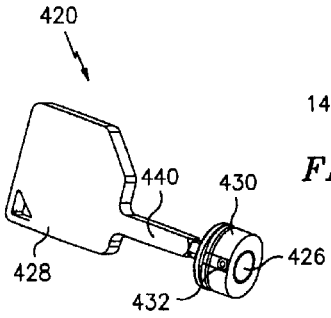
Figure 14C:
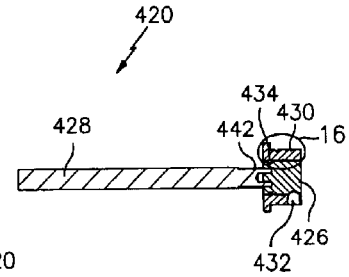
Figure 15B:
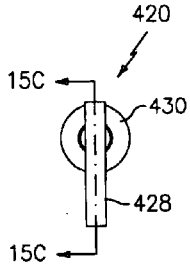
FIGS. 15A–15C are various views (perspective, end plan, and cross-sectional, respectively), of the third embodiment of the integral locking device, in a locked or deployed position.
Figure 15A:
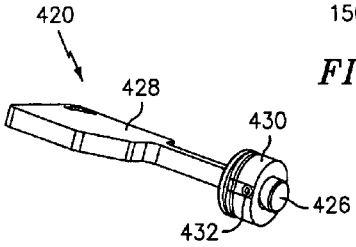
Figure 15C:
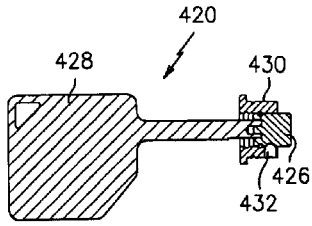

FIGS. 13–15C show a third integral blocking or locking device 420 (blocking means) for firearms, according to the present invention, and suitable for use as the locking device 22. The third integral locking device 420 is generally similar to the second locking device 220, but is preferable in that it is slightly simpler and more compact. As in the first and second embodiments, the third integral locking device 420 is attached to and extends through the side of a firearm. In an unlocked position, as shown in FIGS. 14A–14C, a lock barrel or plunger portion 426 of the locking device 420 is retracted, with the shotgun or other firearm 20 being operable in a normal manner. In a locked position, as shown in FIGS. 15A–15C, with the shotgun's action open, the lock plunger 426 extends into the interior of the shotgun 20, blocking the movement of the shotgun's shell carrier, locking the shotgun open, and rendering the shotgun 20 incapable of firing ammunition.

The locking device 420 comprises: a lock key 428; a lock body 430 with a cylindrical bore; the lock plunger 426; a guide pin 432; and a detent ring 434. The lock key 428 has a narrow neck portion 440, at the end of which is a key engagement portion 442. The key engagement portion 442 is polygon-shaped (triangular, square, pentagonal, hexagonal, octagonal, etc.), and includes a short, axial detent or bore (as best seen in FIGS. 14C and 15C). The lock body 430 further comprises a guide pin hole 444, which is sized to accommodate the guide pin 432 via a tight friction fit. Also, the lock body is quite compact or low profile, i.e., it is dimensioned to be about as thick as the receiver of the firearm for which it is intended.

The lock plunger 426 is generally cylindrical, and is dimensioned to fit within the cylindrical bore of the lock body 430. As best seen in FIG. 13, one end of the plunger is provided with an annular, polygonal recess 446 complementary in shape to the engagement portion 442 of the lock key 428, i.e., it comprises a polygon-shaped recess and a central protuberance or pedestal. The central protuberance prevents a hex wrench or the like from being used to actuate the lock mechanism (also, using a non-conventional shape, such as a triangle or pentagon, further reduces the chances of a conventional wrench or driver being used effectively). The lock plunger 426 is also provided with a close-ended, flat-bottomed, vertically-sided, helical guide groove 448, into which the end of the pin 432 is dimensioned to fit.

Figure 16:
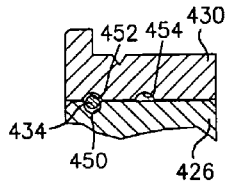
FIG. 16 is a detail view of a portion of the third embodiment of the integral locking device.

To assemble the locking device 420, the detent ring 434 is fit into a matching annular grove 450 provided at one end of the lock plunger 426 (see FIGS. 13 & 16), and the lock plunger 426 is slid into the lock body 430. There, the detent ring 434 lies in a first annular clearance 452 provided in the lock body (see FIG. 16). Then, the lock plunger 426 is rotated until the helical groove 448 aligns with the guide pin hole 444, and the guide pin 432 is press fit into place through the guide pin hole until its end lies within the helical guide groove 448. The pin 432, along with the detent ring 434, keeps the plunger 426 in place in the lock body 430, and facilitates the extension and retraction of the plunger 426, as further discussed below. The pin 432 may be kept in place via a friction fit with the guide pin hole 444, or it may be adhered in place via a standard adhesive. Typically, the pin 432 will lie completely within the hole 444, so that it cannot be easily removed. Also, note that the pin 432 is located towards the rear end of the lock body 430. This positioning maximizes the extent to which the plunger 426 can be extended, thereby facilitating the low profile design of the locking device.

To finish assembling the locking device 420, the lock body 430 and associated components are attached to a firearm, through an appropriately positioned hole or opening (as discussed above), via conventional means.

The operation of the locking device 420 is generally similar to the operation of the second locking device 220 described above. More particularly, to actuate the locking device, the key 428 is used to rotate the plunger 426 clockwise (from the perspective shown in the drawings), via the engagement portion 442 of the key interacting with the polygonal recess 446 in the plunger. As the plunger rotates, the helical groove 448 of the plunger is forced to track along the stationary pin 432 attached to the lock body 430, causing the plunger to extend. At the same time, the detent ring 434, moving along with the plunger, is forced to leave the first annular clearance 452 (see FIG. 16). At the point where the plunger is fully extended, the detent ring 434 falls into a second annular clearance 454 provided in the lock body, thereby preventing the plunger from moving to its retracted position of its own accord (as further aided by the pin 432). To disengage the locking device, the operation is reversed.

Although various procedures for assembling the integral locking devices have been described herein, one of ordinary skill in the art will appreciate that the assembly procedures, including the means by which various elements are connected to one another, where applicable, could be changed without departing from the spirit and scope of the invention. For example, the lock body nut 238 could be welded or adhered to the lock body 230.

Furthermore, although the end cap stops have been illustrated as comprising extensions of the portion of the end cap defining the central cylindrical portion of the end cap's longitudinal through space, one of ordinary skill in the art will appreciate that differently shaped and/or positioned stops (bumps, protuberances, etc.) could be provided instead without departing from the spirit and scope of the invention.

Also, although the method of the present invention has been illustrated as involving determining the union of three particular sets of locations on a firearm, one of ordinary skill of the art will appreciate that it may not be possible to find such a location or set of locations, depending on the particular type and model of firearm. In such a case, a union of two of the sets of locations that meet the above criteria can be determined. For example, if a firearm's design does not accommodate placing the locking device 22 at a location where, to the extent one is able to operatively disassemble the firearm when the locking device is locked, the locking device cannot be accessed and/or defeated internally, positioning a locking device at a location chosen according to the first two factors (e.g., blocks the action, and can only be locked when the action is open) will still provide a beneficial measure of security, e.g., in the case of unauthorized users who may be unable to disassemble the firearm or who may not have time to do so. Additionally, the locking devices could be used in any location in any firearm where an inwardly extending plunger would otherwise somehow prevent the firearm from being fired or loaded with ammunition, the trigger from being pulled, the safety from being moved to "off," a shell from being chambered, etc.

Although the locking devices have been illustrated as comprising key-actuated locks, one of ordinary skill in the art will appreciate that the locking device could be completely internal and actuated via a remote signal, without departing from the spirit and scope of the invention.

Since certain changes may be made in the above described method for locking a firearm, without departing from the spirit and scope of the invention herein involved, it is intended that all of the subject matter of the above description or shown in the accompanying drawings shall be interpreted merely as examples illustrating the inventive concept herein and shall not be construed as limiting the invention.

Having thus described the invention, what is claimed is:

1. A firearm comprising:

a. a receiver;

b. an action attached to the receiver; and c. an integral locking device attached to the receiver, wherein:

d. the locking device can be actuated to interfere with a portion of the action, thereby preventing the firearm from being fired; the locking device can only be actuated when the action is in an open position; and the locking device cannot be accessed and/or defeated internally to the extent the firearm can be operatively disassembled when the locking device is actuated; and e. the locking device is a plunger lock comprising: a lock body attached to the receiver and having an axial bore; a lock plunger disposed in the axial bore and having a helical guide grove; a guide pin attached to the lock body, said guide pin having an end that lies within the helical guide groove; and a lock key configured to engage an end of the plunger accessible from the exterior of the firearm; wherein when the lock key is used to rotate the plunger, the helical guide groove of the plunger is forced to track along the guide pin attached to the lock body, causing the plunger to extend or retract.

2. A firearm comprising:

a. receiver;

b. an action attached to the receiver; and c. an integral locking device attached to the receiver, wherein:

d. the locking device can be actuated to interfere with a portion of the action, thereby preventing the firearm from being fired: the locking device can only be actuated when the action is in an open position; and the locking device cannot be accessed and/or defeated internally to the extent the firearm can be operatively disassembled when the locking device is actuated; and e. the locking device is a plunger lock attached to the receiver, wherein the lock has a plunger that selectively can be extended into an interior of the receiver to block the action or retracted to unblock the action.

3. In a firearm of the type having a receiver and an action between open and closed positions created within the receiver, by an action bar, a bolt, an elevator, and a bolt slide, the improvement comprising:

a. locking means to prevent the firearm from being fired, wherein the locking means is integrally attached to the receiver and includes a plunger that can be extended into an interior of the receiver to interfere with the action, and subsequently retracted to unblock the action, only when the action is in the open position, wherein the locking means cannot be accessed and/or defeated internally to the extent the firearm can be operatively disassembled when the plunger is extended.

* * * * *

UNITED STATES PATENT AND TRADEMARK OFFICE

CERTIFICATE OF CORRECTION

PATENT NO. : 6,871,437 B1
DATED : March 29, 2005
INVENTOR(S) : Joseph H. Bartozzi et al.

It is certified that error appears in the above-identified patent and that said Letters Patent is hereby corrected as shown below:

Title page,
Item [75], Inventors, delete "Robert A. Talboot" and insert -- Robert A. Talbot --.

Column 4,
Line 34, delete "to" after the word "move".

Column 8,
Line 45, delete "to" after the word "with".

Column 9,
Line 7, delete "28" after the word "key" and insert -- 128 --.

Column 10,
Line 3, delete "FIGS. 11-12" and insert -- FIGS. 11A-12 --.
Line 67, insert -- 308 -- after the word "groove".

Column 11,
Line 23, insert -- the -- after the word "and".

Column 14,
Line 39, delete "grove" and insert -- groove --.

Signed and Sealed this

Seventh Day of June, 2005

JON W. DUDAS
*Director of the United States Patent and Trademark Office*